US005285924A

United States Patent [19]

Morris

[11] Patent Number: 5,285,924

[45] Date of Patent: Feb. 15, 1994

[54] SLIDABLE BEVERAGE CONTAINER COVER

[76] Inventor: Kenneth S. Morris, 2616 Ridge Brook Trail, Duluth, Ga. 30136

[21] Appl. No.: 17,762

[22] Filed: Feb. 16, 1993

[51] Int. Cl.[5] ..... A47G 19/22

[52] U.S. Cl. ..... 220/694; 220/729; 220/336

[58] Field of Search ..... 220/254, 258, 259, 336, 220/694, 716, 729

[56] References Cited

U.S. PATENT DOCUMENTS

| | | | |
|---|---|---|---|
| 4,339,053 | 7/1982 | Tarro | 220/269 |
| 4,366,914 | 1/1983 | Ingram | 220/287 |
| 4,717,039 | 1/1988 | Ayyoubi | 220/253 |
| 4,752,016 | 6/1988 | Eads | 220/253 |
| 4,842,159 | 6/1989 | Hiedrich | 220/336 X |
| 4,852,763 | 8/1989 | Dimberio | 220/253 |
| 4,869,389 | 9/1989 | Cerrone, Jr. . | |
| 4,880,136 | 11/1989 | Englert | 220/253 |

*Primary Examiner*—Allan N. Shoap
*Assistant Examiner*—Nova Stucker
*Attorney, Agent, or Firm*—Jason A. Bernstein

[57] ABSTRACT

A plastic slidable removable cover for a beverage container, such as a soda can, that can cover or expose the can opening using the same hand that grasps the container. The cover comprises a tab portion that fits under the rivet of a conventional soda can pull ring and covers the opening created, a periphery engaging portion that grips the lip of the can, and a plurality of serrations facilitating easy sliding of the cover around the lip periphery. The cover can be easily removed for use with other containers.

4 Claims, 2 Drawing Sheets

SLIDABLE BEVERAGE CONTAINER COVER

FIELD OF THE INVENTION

The present invention relates to closure devices, and, more particularly, to a slidable removable cover for beverage containers such as soda cans.

BACKGROUND OF THE ART

In recent years the beverage industry has standardized the overall shape and size of the typical soda pop can. The advent of the pull tab opening mechanism has reduced the prevalence of the sharp metal rings and produced a convenient beverage container. Once opened, the container cannot be conveniently resealed or the opening covered without resort to externally attached covers. Insects and dirt can enter the container and fluid can escape if it is jostled or tipped over. A number of instances have occurred where bees and wasps have crawled into an open container and stung the unsuspecting user on the lips or tongue. Should the user be allergic to bee stings an otherwise enjoyable outing can become a nightmare resulting in a trip to the hospital or possibly even death. It would be desirable to have a means for covering the opening to prevent entry of unwanted material or bugs, yet have the opening be easily accessible when the user wants to take a drink. Covers have been developed that require the user to first completely remove the cover from the container before taking a drink resulting in the user having to hold the cover in the other hand. Other covers do not provide a convenient means for grasping the cover and increase the opportunity to break a nail or spill the contents while opening the cover.

It would be desirable to have a cover that would cover just the opening of the can, that would easily slide to one side to permit sipping of the beverage, and that would be removable and reusable.

Accordingly it is a principal object of the present invention to provide a removable closure means for a beverage container.

It is another object of the present invention to provide an inexpensive reusable cover for covering a conventional soda can.

It is another object of the present invention to provide a slidable cover for a beverage container that can be manipulated by the same hand that holds the container.

SUMMARY OF THE INVENTION

The present invention remedies the deficiencies in the prior art and provides an improved beverage can cover. More particularly, the present invention provides a slidable removable cover for a commonly available beverage container, such as a soda can, having a generally cylindrical shape, a tab opener which when pulled will create an opening in the container and a circumferential lip defining an inner and an outer periphery, comprising: a tab portion having upper and lower surfaces and a front and rear portion; an inner periphery engaging portion attached to the rear of the tab portion comprising a curved inner raised flange having an upper and lower edge and an inner radius of curvature generally corresponding to the radius of the circumferential lip; and, an outer periphery engaging portion comprising an outer flange extending from the upper edge of the inner flange, the outer flange having inner and outer surfaces and having a curved outer portion curved away from the inner flange, a portion of the ends of the curved outer portion being angled in toward the inner flange, the ends capable of engaging the outer periphery, and having a generally horizontal rib attached to the inner surface of the outer flange whereby the inner flange, a portion of the outer flange and the ends of the outer flange define a curved gripping surface capable of engaging the circumferential lip such that the cover can be rotated around the circumferential lip to bring the tab portion over the container opening thereby covering the opening.

The cover of the present invention can be fitted onto the container and slidingly rotated around the lip of the container so that the user can cover or reveal the opening. In this manner bees, ants and other insects, as well as dirt can be prevented from contaminating the fluid contents. Furthermore, the cover can reduce the fluid loss in the event the container is jostled or tipped over.

DESCRIPTION OF THE PREFERRED EMBODIMENTS

Figure 1A:
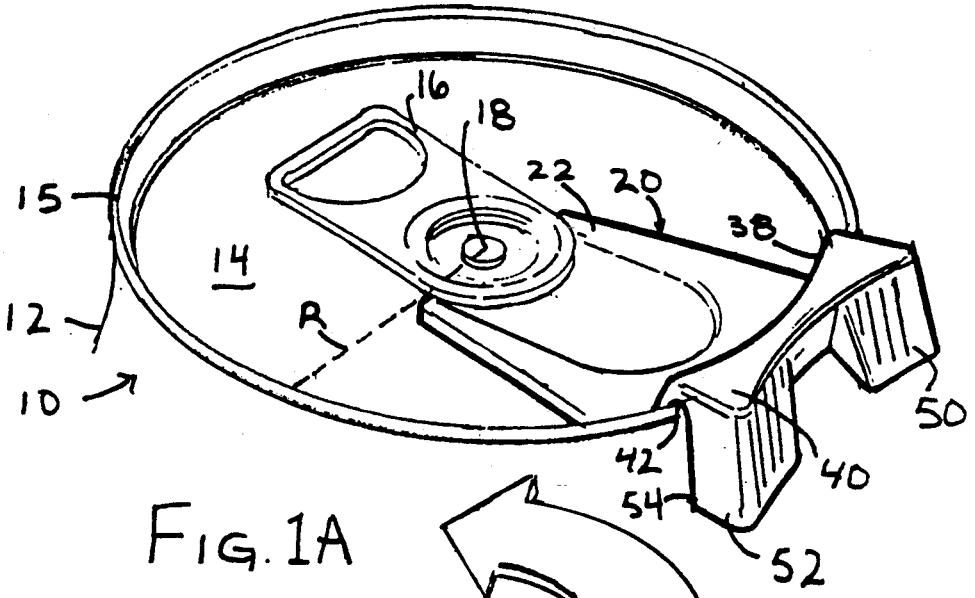
FIG. 1A is a perspective view of a container and a cover of the present invention shown in place over the container opening.
Figure 1B:
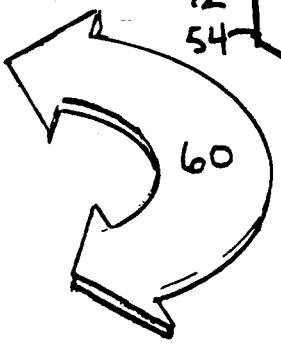
FIG. 1B is a perspective view of a container and a cover of the present invention shown rotated away from the container opening.
Figure 1B:
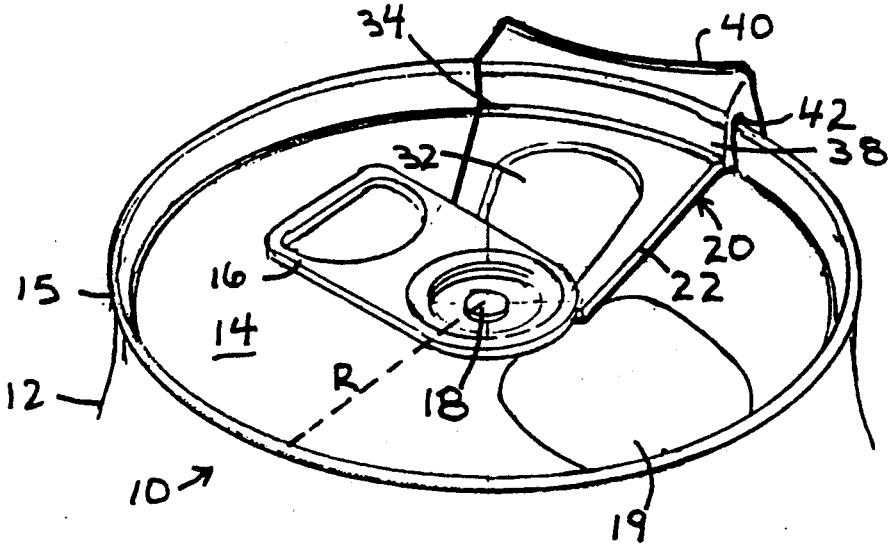
Figure 2:
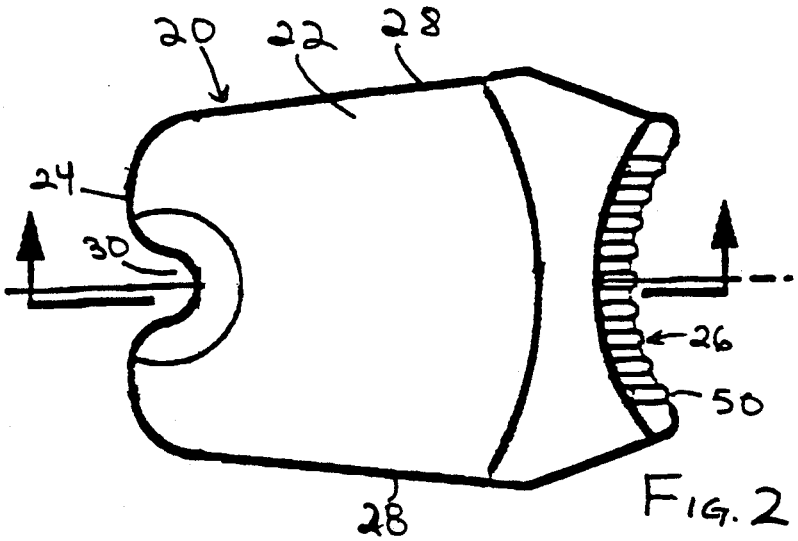
FIG. 2 is a top view of a cover of the present invention.

Referring to the drawings in which like numerals describe like parts throughout the several figures, FIGS. 1A and B and FIG. 2 show a perspective view of a beverage container 10 and a cover 20 of the present invention. The container 10 is a standard soda can or similar shape having a cylindrical wall 12, a lid 14 and a lip 15 circumferentially surrounding the wall 12. The lip 15 has a radius of curvature noted as "R". Attached to the lid 14 is a tab opener 16 commonly used in the industry. The tab 16 is attached by a rivet 18. An opening 19 is created when a portion of the lid 14 is pushed into the container 10 in a conventional manner, giving access to the liquid inside.

The cover 20 is preferably made of a plastic material, such as polypropylene or other polymer and preferably has some degree of flexibility. It is to be understood that other suitable materials can be used, such as, but not limited to, metal, wood, ceramic, composite, fiber, and the like. The cover 20 comprises a tab 22 having a front end 24, a rear end 26 and sides 28. The sides 28 preferably taper from rear to front, but can be parallel or divergent. A notch 30 having an arcuate shape is located at front end 24. The tab 22 has a depressed inset portion 32 (when viewed from above) that roughly corresponds to the shape of opening 19. The rear 26 is curved, having a radius R. An annular channel portion 34 is disposed at rear 26 that corresponds to radius R.

Figure 3:
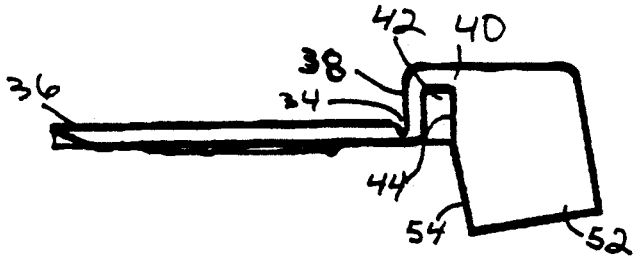
FIG. 3 is a side view of the present invention.

FIG. 3 is a side view of cover 20 shows that tab 22 has a slightly ramped portion 36 upward toward front 24. This ramp 36 creates a slightly forced fit when tab 22 is fitted under tab opener 16.

Figure 4:
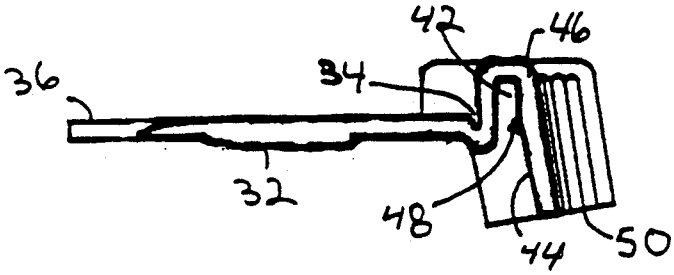
FIG. 4 is a side cutaway view of the present invention.
Figure 5:
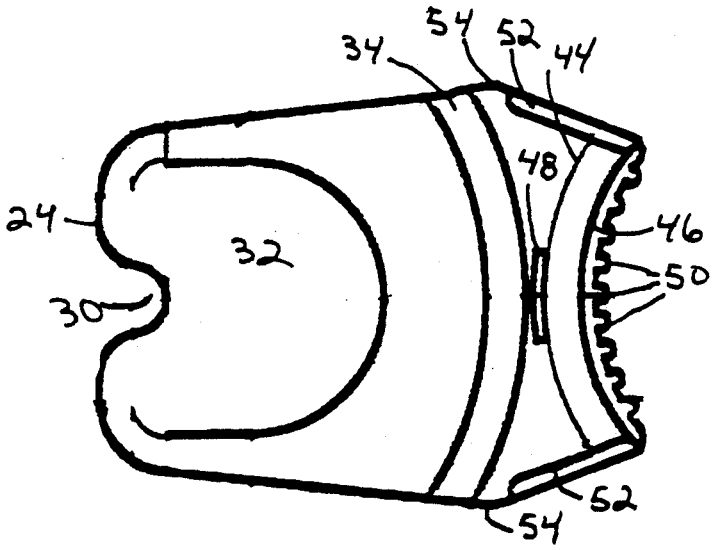
FIG. 5 is a bottom view of the present invention.

Projecting upward from rear 26 is a flange 38, having a radius corresponds to the radius of lip 15. Projecting downward from the rear portion of flange 38 is an outer flange 40, which curves in a direction opposite that of flange 38. Between flange 38 and outer flange 40 is disposed an annular groove 42 having a radius of curvature generally corresponding to radius R. The outer flange 40 has an inner wall 44 and an outer wall 46. A horizontal rib 48 projects from inner wall 44, as shown in FIG. 4. On outer wall 46 are preferably at least one serration 50, as shown in FIG. 5. The outer flange 40 has ends 52 which angle back toward sides 28. Each end 52 terminates in an edge 54, the upper portion of which is generally parallel to flange 38 and the lower portion of which flares away from tab 22.

The cover 20 is mounted onto container 10 by slipping tab 22 under tab opener 16 in a direction from lip 15 to rivet 18. The notch 30 fits around rivet 18. The groove 42 will fit over lip 15 and form a press fit, where the inner edge of lip 15 is gripped by flange 38 and the outer edge of lip 15 is gripped underneath the lip by rib 48 and the upper portion of outer flange edge 54. When the ramp portion 36 of tab 22 is slid under tab opener 16 it forces insert 32 down slightly to provide a better seal over opening 19 and to maintain cover 20 in proper alignment with container 10. The cover 20 can be slid around lip 15 when a user is grasping container 10 by manipulating the outer flange ends 52 with the thumb or other fingers of either hand. The serrations 50 improve gripping ability. In this manner, a user, having opened a container 10, can close off opening 19 by sliding cover 20 in the direction of arrow 60 to cover the opening, and, can gain access to the beverage by sliding cover 20 either way around lip 15 to uncover the opening, as seen in FIGS. 1A and B.

It is an advantage of the present invention that the cover grips the container by the inner as well as the outer edges of lip 15 because this permits the cover to be slid around the lip without undesirably popping off. Yet, a user can easily remove the cover by applying upward pressure to outer flange 40. The user can manipulate cover 20 and hold the container with the same hand by sliding cover 20 in either direction around the top with the thumb or other finger It is to be understood that by minor modification cover 20 of the present invention can be used with containers of various diameters, shapes and opening sizes. A certain degree of tolerance for different diameter lips is built into the design of the present invention. While the invention has been described in connection with certain preferred embodiments, it is not intended to limit the scope of the invention to the particular forms set forth, but, on the contrary, it is intended to cover such alternatives, modifications, and equivalents as may be included within the spirit and scope of the invention as defined by the appended claims.

I claim:

1. A slidable removable cover for a beverage container, said container having a generally cylindrical shape and a radius top and bottom ends, a tab opener which when pulled will create an opening in said top end of said container and a circumferential lip at said top end defining an inner and an outer periphery, comprising:

a tab portion having upper and lower surfaces, and a front and rear portion;

an inner periphery engaging portion attached to the rear of said tab portion comprising a curved inner raised flange having an upper and lower edge and having an inner radius of curvature dimensioned for mating relationship with said circumferential lip; and an outer periphery engaging portion comprising an outer flange attached to the upper edge of said inner flange, said outer flange having inner and outer surfaces and having a curved outer portion terminating in a pair of ends, said curved outer portion being curved away from said inner flange, the ends of said curved outer portion being angled in toward said inner flange, said ends of said curved outer portion being capable of engaging said outer periphery, and said inner portion of said outer flange having a generally horizontal rib attached to said inner surface of said outer flange, whereby said inner flange, a portion of said outer flange and said ends of said outer flange define a curved gripping surface capable of engaging said circumferential lip such that said cover can be rotated around said circumferential lip to bring said tab portion over said container opening thereby covering said opening.

2. The cover of claim 1, wherein said outer flange has at least one serration on said curved outer portion.

3. The cover of claim 1, wherein said tab portion contains a depressed inset portion and a curved opening defined within said front portion capable of engaging a portion of said tab opener.

4. The cover of claim 3, wherein said depressed inset portion is generally circle-shaped.

* * * * *